US007224315B2

(12) United States Patent
Tsai et al.

(10) Patent No.: US 7,224,315 B2
(45) Date of Patent: May 29, 2007

(54) ELECTRONIC DEVICE AND ANTENNA STRUCTURE THEREOF

(75) Inventors: Feng-Chi Eddie Tsai, Taipei Hsien (TW); Chia-Tien Li, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 54 days.

(21) Appl. No.: 11/273,867

(22) Filed: Nov. 14, 2005

(65) Prior Publication Data

US 2007/0018902 A1 Jan. 25, 2007

(30) Foreign Application Priority Data

Jul. 22, 2005 (TW) ..... 94212492 U

(51) Int. Cl.
*H01Q 1/38* (2006.01)

(52) U.S. Cl. ..... 343/700 MS; 343/816

(58) Field of Classification Search ..... 343/700 MS, 343/795, 816, 820
See application file for complete search history.

(56) References Cited

U.S. PATENT DOCUMENTS 4,203,116 A * 5/1980 Lewin ..... 343/700 MS
6,339,404 B1 1/2002 Johnson et al.
6,741,219 B2 * 5/2004 Shor ..... 343/795
6,747,605 B2 * 6/2004 Lebaric et al. ..... 343/795

* cited by examiner

*Primary Examiner*—Hoang V. Nguyen
(74) *Attorney, Agent, or Firm*—Quintero Law Office

(57) ABSTRACT

An antenna structure comprises a substrate, a reflective element, a first radiation unit, a second radiation unit, a first impedance matching unit, a second impedance matching unit, a feed point, a first conductive line and a second conductive line. The substrate comprises a first surface and a second surface. The reflective element is disposed on the second surface. The first and the second radiation units are disposed on both sides of the reflective element. The first impedance matching unit is disposed on the first surface corresponding to the first radiation unit. The second impedance matching unit is disposed on the first surface corresponding to the second radiation unit. The feed point is coupled between the first impedance matching unit and the second impedance matching unit. The first conductive line is coupled to the feed point. The second conductive line is coupled to the reflective element.

20 Claims, 7 Drawing Sheets

ELECTRONIC DEVICE AND ANTENNA STRUCTURE THEREOF

BACKGROUND

The invention relates to an antenna structure, and more particularly to an antenna structure providing improved radiation pattern.

FIGS. 1*a* and 1*b* show an antenna structure 12 disclosed in U.S. Pat. No. 6,339,404, which comprises a substrate 14, radiation elements 22, a conductive element 24, a conductive element 26, a reflective element 28, impedance matching elements 46 and cables 44. The substrate 14 comprises a first surface 16 and a second surface 18. The reflective element 28 is disposed on the first surface 16. The radiation elements 22 are disposed on two sides of the reflective element 28. The cables 44 comprise conductive lines 42 and 48. The conductive lines 42 are coupled to the reflective element 28. The conductive element 24, the conductive element 26 and the impedance matching elements 46 are disposed on the second surface 18. The conductive element 24 and the conductive element 26 are connected to the impedance matching elements 46. The conductive lines 48 are coupled to the conductive element 24 and the conductive element 26.

Conventional antenna structure 12, however, comprises two conductive lines 48, two independent impedance matching elements 46 and two conductive elements 24 and 26, the structure thereof is complicated, and the radiation pattern cannot be improved by modifying the conductive line 48, or the conductive elements 24 and 26. Additionally, when a plurality of antenna structures 12 are connected in parallel to achieve an improved signal transmission, the size thereof is large.

SUMMARY

An embodiment of an antenna structure for transmitting a wireless signal comprises a substrate, a reflective element, a first radiation unit, a second radiation unit, a first impedance matching unit, a second impedance matching unit, a feed point, a first conductive line and a second conductive line. The substrate comprises a first surface and a second surface. The reflective element is disposed on the second surface. The first radiation unit is disposed on both sides of the reflective element. The second radiation unit is disposed on both sides of the reflective element. The first impedance matching unit is disposed on the first surface corresponding to the first radiation unit. The second impedance matching unit is disposed on the first surface corresponding to the second radiation unit. The feed point is coupled between the first impedance matching unit and the second impedance matching unit. The first conductive line is coupled to the feed point. The second conductive line is coupled to the reflective element.

The antenna structure of the invention can be disposed in a housing of an electronic device.

The antenna structure of the invention provides a more symmetrical radiation pattern and improved signal transmission with smaller size.

DESCRIPTION OF THE DRAWINGS

The invention will be more fully understood from the following detailed description and the accompanying drawings, given by the way of illustration only and thus not intended to limit the invention.

DETAILED DESCRIPTION

Figure 1A:
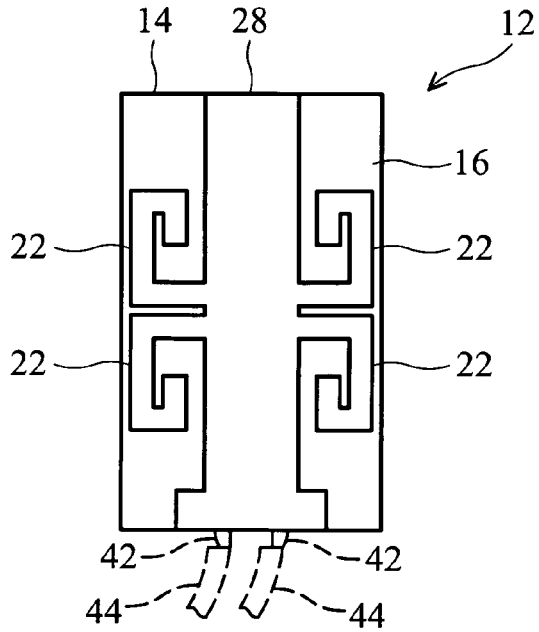
FIG. 1a (RELATED ART)
FIG. 1*a* is a bottom view of a conventional antenna structure.
Figure 1B:
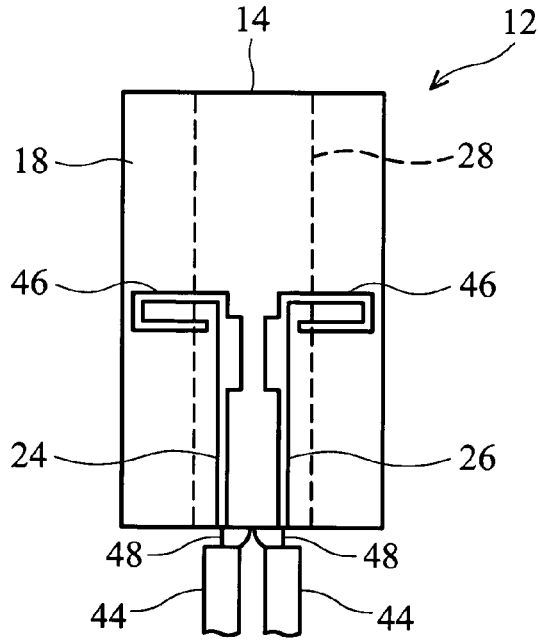
FIG. 1b (RELATED ART)
FIG. 1*b* is a top view of the conventional antenna structure.
Figure 2A:
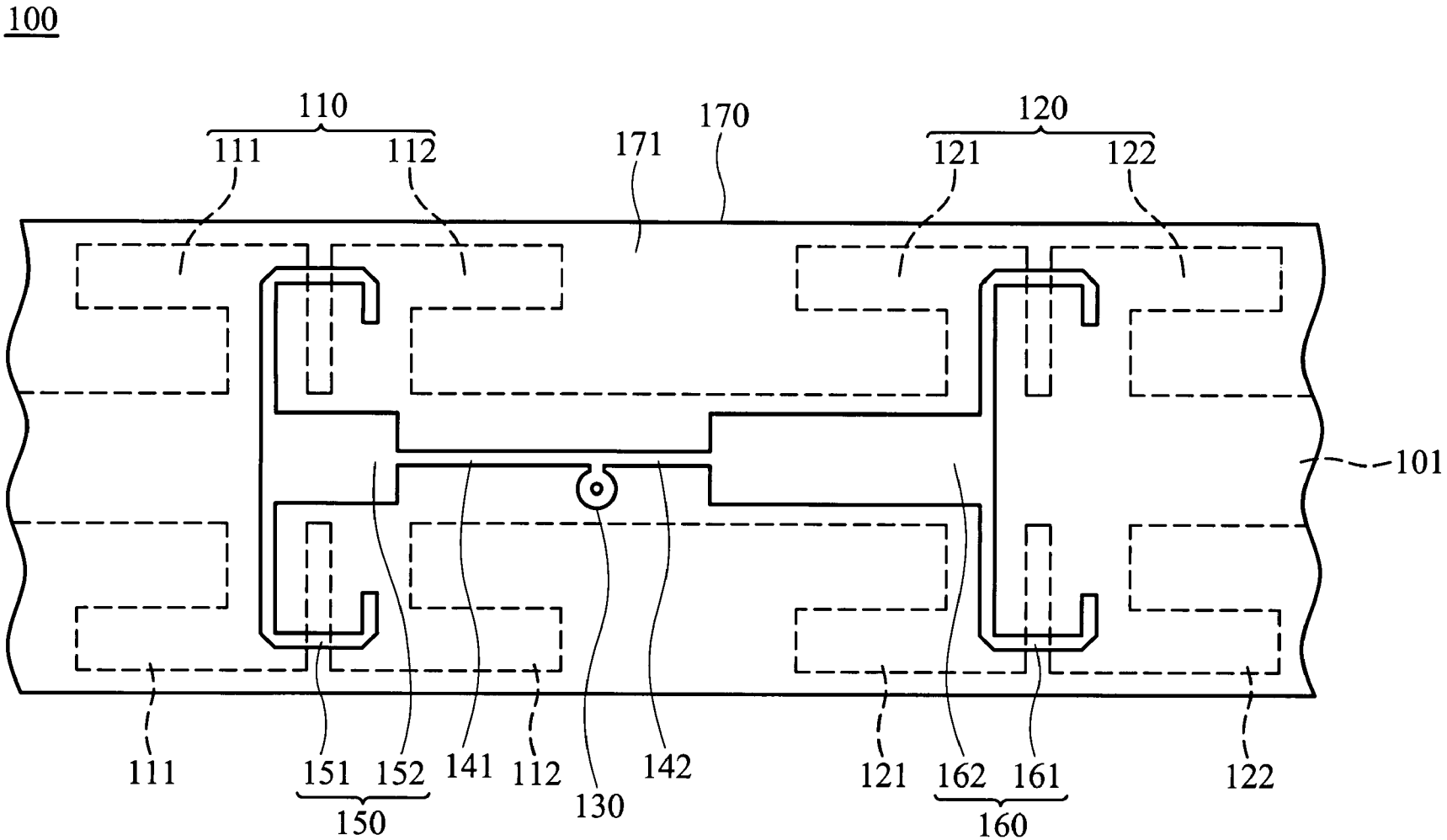
FIG. 2*a* shows an antenna structure of the invention.
Figure 2B:
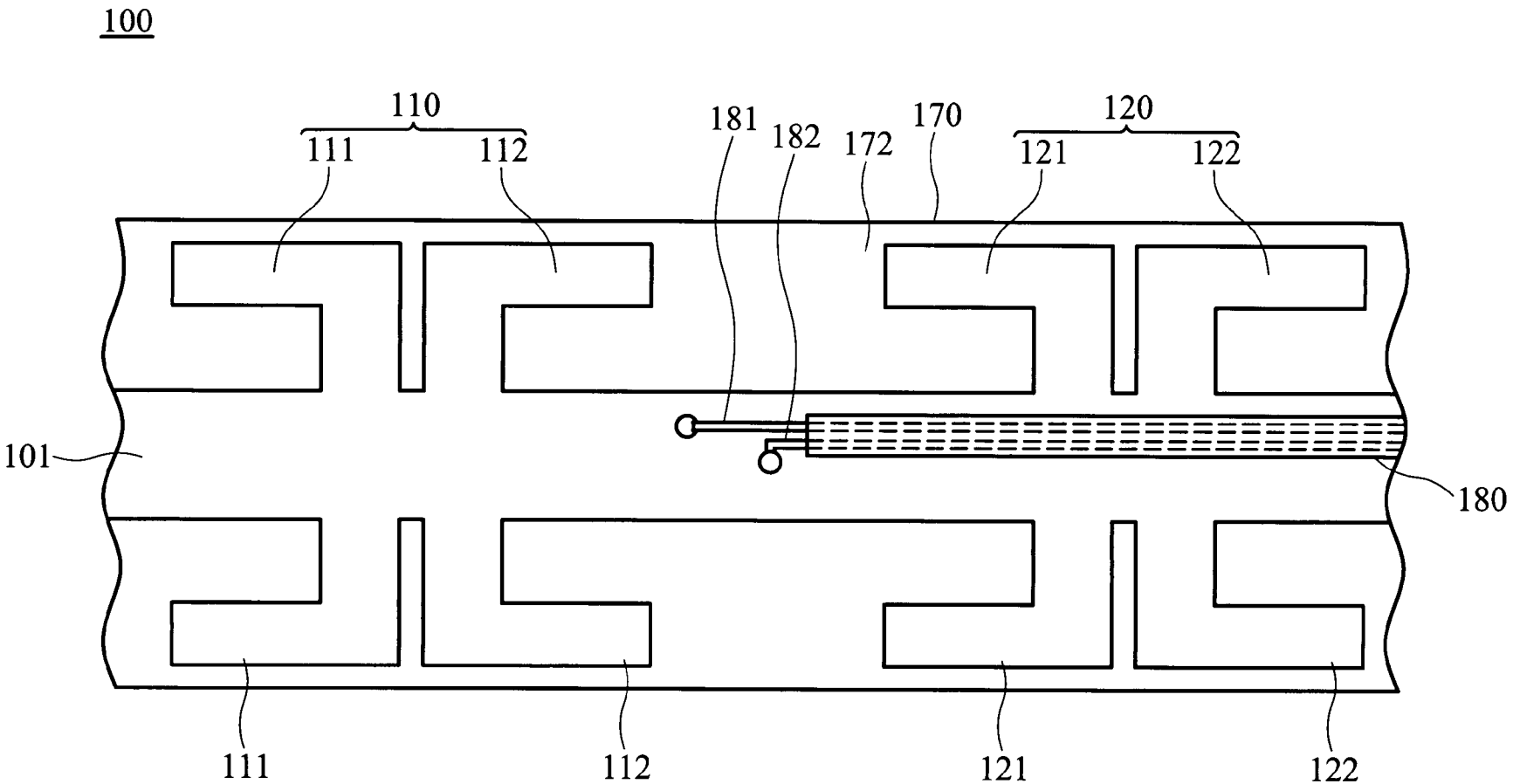
FIG. 2*b* is a bottom view of the antenna structure of the invention.

FIGS. 2*a* and 2*b* show an antenna structure 100 of the invention, which comprises a substrate 170, a reflective element 101, a first radiation unit 110, a second radiation unit 120, a feed point 130, a first impedance matching unit 150, a second impedance matching unit 160, a first conductive element 141 and a second conductive element 142. The substrate 170 comprises a first surface 171 and a second surface 172 (with reference to FIG. 2*b*). The reflective element 101, the first radiation unit 110 and the second radiation unit 120 are disposed on the second surface 172. The reflective element 101 is longitudinal. The first radiation unit 110 and the second radiation unit 120 are disposed on two sides of the reflective element 101. The first impedance matching unit 150, the second impedance matching unit 160, the first conductive element 141, the second conductive element 142 and the feed point 130 are disposed on the first surface 171. The first impedance matching unit 150 is connected to the first conductive element 141, and the first conductive element 141 is connected to the feed point 130. The second impedance matching unit 160 is connected to the second conductive element 142, and the second conductive element 142 is connected to the feed point 130. The first impedance matching unit 150 is a sleeve-shaped structure corresponding to the first radiation unit 110, and the second impedance matching unit 160 is a sleeve-shaped structure corresponding to the second radiation unit 120.

With reference to FIG. 2*b*, the antenna structure 100 further comprises a cable 180. The cable 180 comprises a first conductive line 181 and a second conductive line 182. The first conductive line 181 is coupled to the feed point 130 and passes through the reflective element 101 and the substrate 170. The second conductive line 182 is coupled to the reflective element 101. The first radiation unit 110 comprises two radiation elements 111 and two radiation elements 112 disposed on both sides of the reflective element 101, wherein each side of the reflective element 101 comprises one radiation element 111 and one radiation element 112 disposed thereon. The radiation elements 111 and the radiation elements 112 are L-shaped, and the ends thereof extend in opposite directions. The second radiation unit 120 comprises two radiation elements 121 and two radiation elements 122 disposed on both sides of the reflective element 101, wherein each side of the reflective element 101 comprises one radiation element 121 and one radiation element 122 disposed thereon. The radiation elements 121 and the radiation elements 122 are L-shaped, and the ends thereof are extending in opposite directions.

Figure 3:
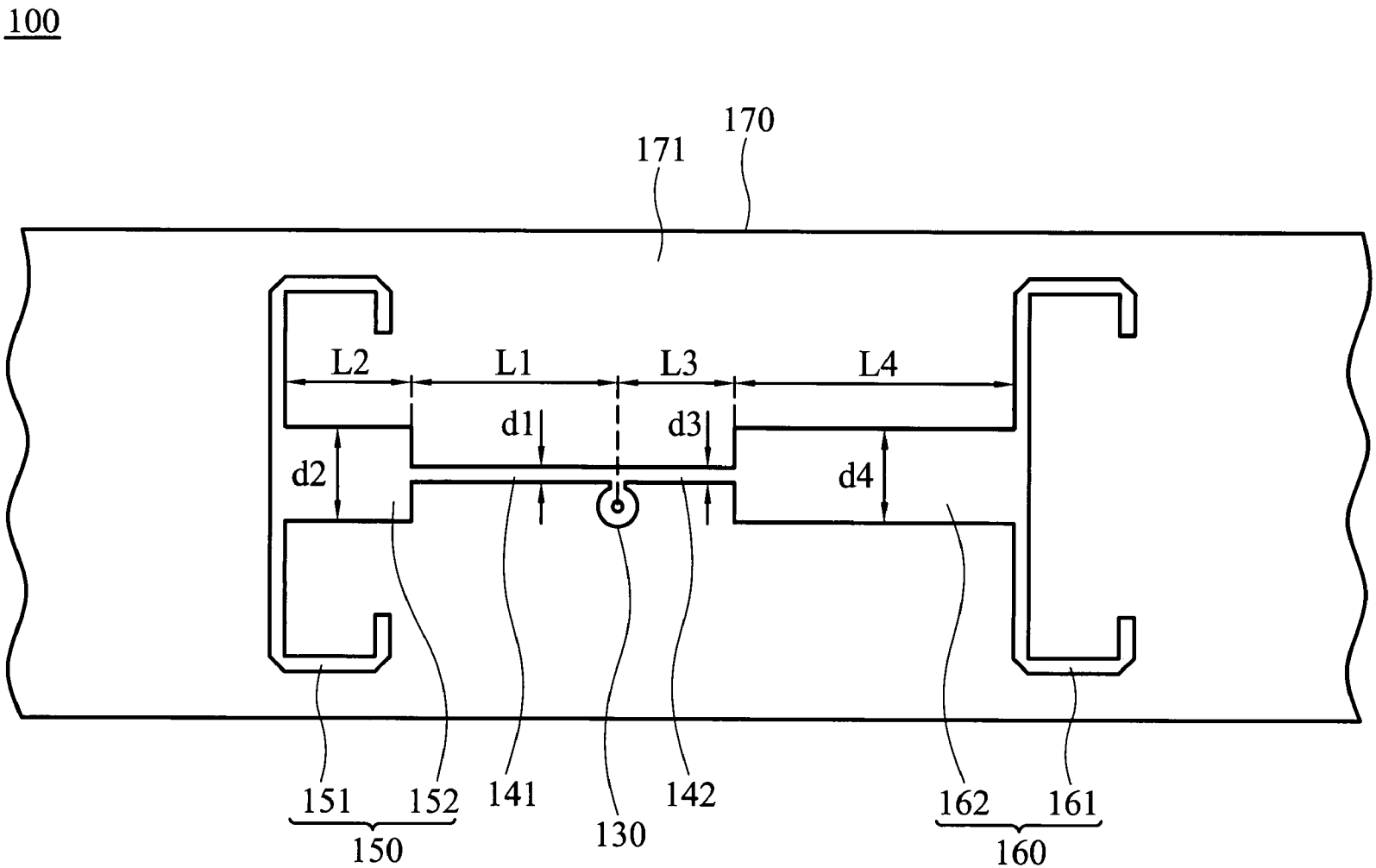
FIG. 3 is a top view of the antenna structure of the invention.

With reference to FIG. 3, the first conductive element 141 and the second conductive element 142 are aligned on a straight line. The first impedance matching unit 150 comprises a first portion 151 and a second portion 152. The first portion 151 is corresponding to the first radiation unit 110, the second portion 152 is connected to the first conductive element 141, and the first portion 151 is connected to the second portion 152.

The second impedance matching unit 160 comprises a third portion 161 and a fourth portion 162. The third portion 161 is corresponding to the second radiation unit 120, the fourth portion 162 is connected to the second conductive element 142, and the third portion 161 is connected to the fourth portion 162.

The width d1 of the first conductive element 141 is thinner than the width d2 of the second portion 152. The impedance matching of the antenna structure 100 is modified by changing the width d1 of the first conductive element 141 and the width d2 of the second portion 152. The radiation pattern of the antenna structure 100 is modified by changing the length L1 of the first conductive element 141 and the length L2 of the second portion 152. The width d3 of the second conductive element 142 is thinner than the width d4 of the fourth portion 162. The impedance matching of the antenna structure 100 is modified by changing the width d3 of the second conductive element 142 and the width d4 of the fourth portion 162. The radiation pattern of the antenna structure 100 is modified by changing the length L3 of the second conductive element 142 and the length L4 of fourth portion 162.

A total length of the first conductive element 141, the second conductive element 142, the second portion 152 and the fourth portion 162 is about 0.8λ~1λ, and λ is a wave length of the wireless signal. The length L1 of the first conductive element 141, the length L2 of the second portion 152, the length L3 of the second conductive element 142 and the length L4 of the fourth portion 162 can be modified to achieve improved signal transmission.

Figure 4:
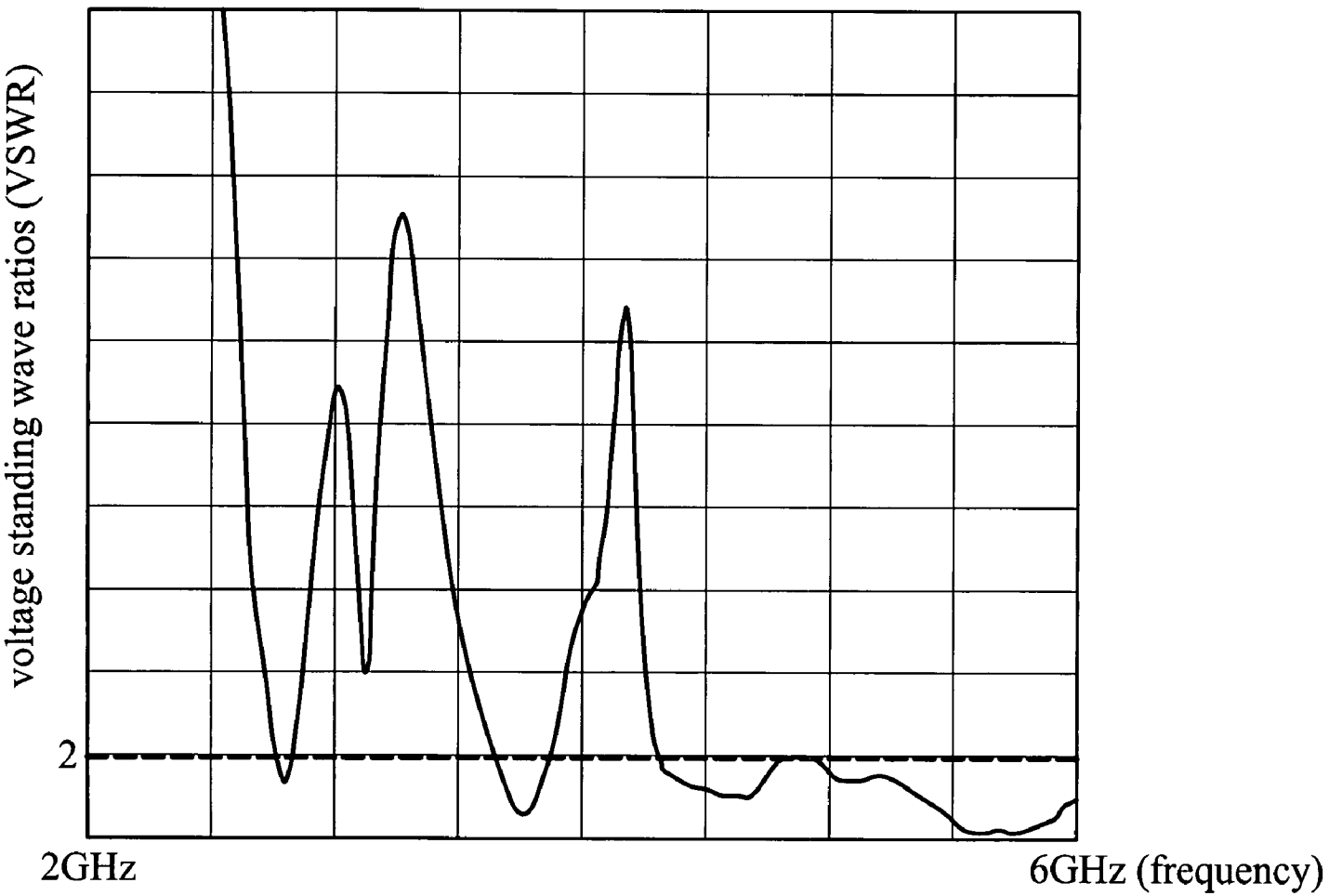
FIG. 4 shows signal transmission of the antenna structure of the invention.

FIG. 4 shows the signal transmission of the antenna structure 100 of the invention, wherein the bands thereof (bands are defined as signals having voltage standing wave ratios lower than 2) is between 4.85 GHz~6 GHz.

Figure 5:
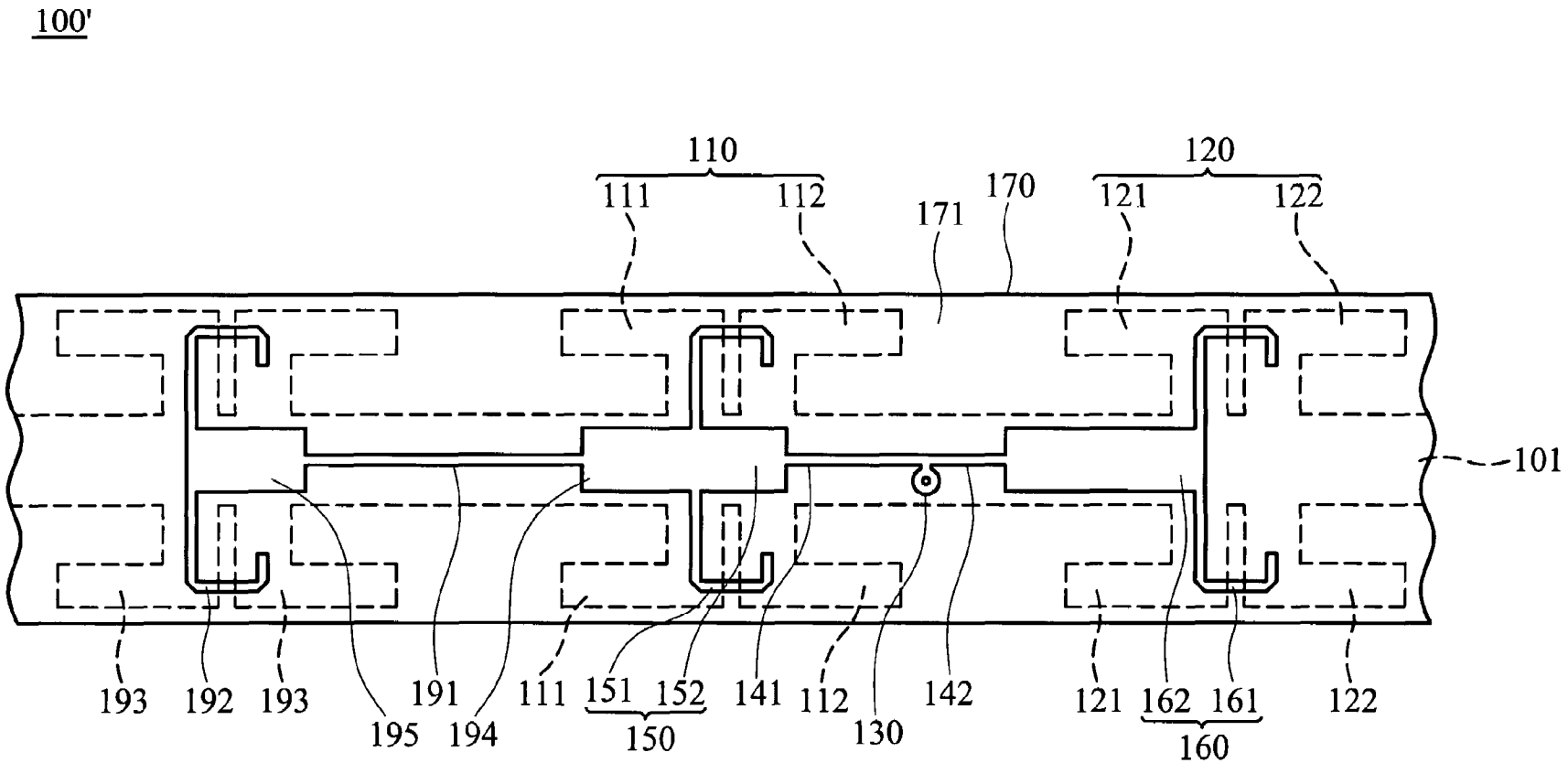
FIG. 5 shows a modified example of the antenna structure of the invention.

FIG. 5 shows a modified antenna structure 100' of the invention, which further comprises a third conductive element 191, an impedance matching element 192, an impedance matching element 194, an impedance matching element 195 and a third radiation unit 193. The impedance matching element 194 is connected to the first impedance matching unit 150. The third conductive element 191 is connected to the impedance matching element 194. The impedance matching element 195 is connected to the third conductive element 191. The impedance matching element 192 is connected to the impedance matching element 195. The impedance matching element 192 and the impedance matching element 195 compose a third impedance matching unit. The third radiation unit 193 is disposed on two sides of the reflective element 101. The third conductive element 191, the impedance matching element 192, the impedance matching element 194, the impedance matching element 195 and the third radiation unit 193 symmetrize the radiation pattern of the antenna structure 100'.

The antenna structure of the invention is utilized in transmitting various wireless signals, particularly signals conformed to IEEE 802.11(a).

The antenna structure of the invention provides a more symmetrical radiation pattern and improved signal transmission with smaller size.

Figure 6:
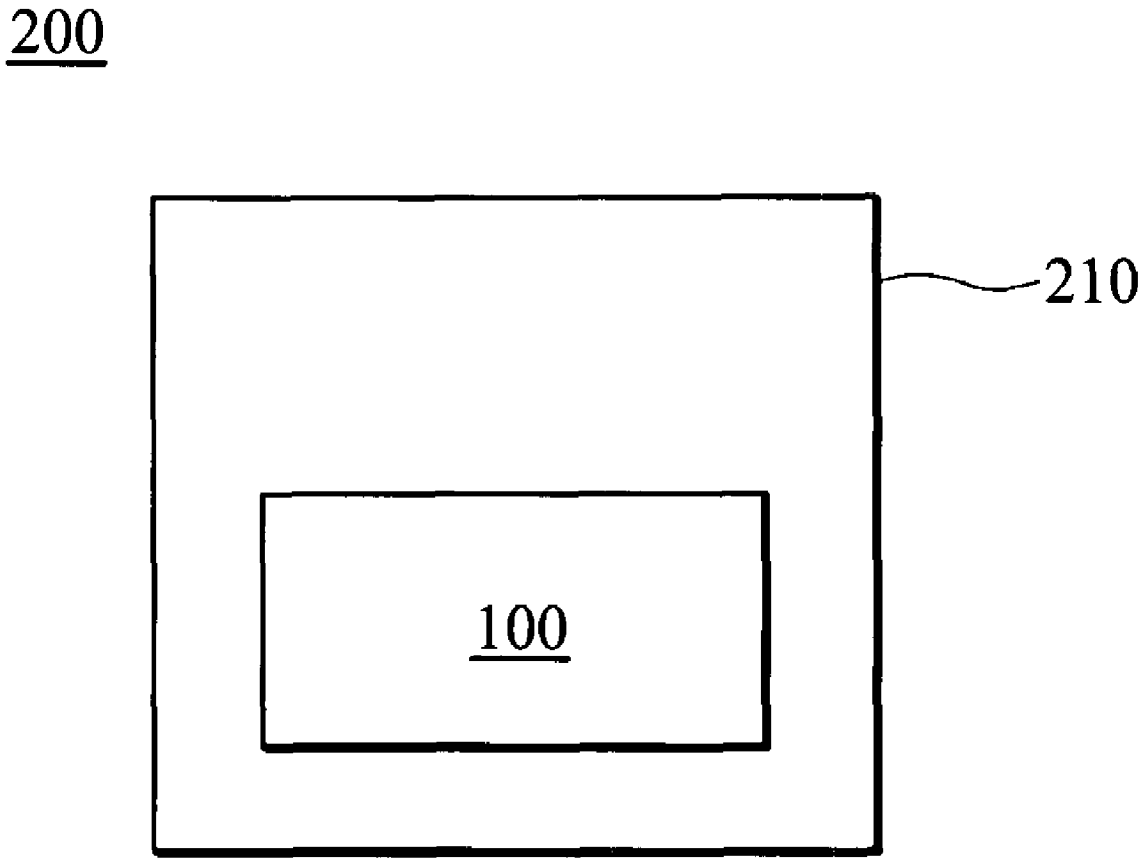
FIG. 6 shows the antenna structure of the invention disposed in an electronic device.

With reference to FIG. 6, the antenna structure 100 of the invention can be disposed in a housing 210 of an electronic device 200.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna structure for transmitting a wireless signal, comprising:

a substrate, comprising a first surface and a second surface;

a reflective element, disposed on the second surface;

a first radiation unit, disposed on both sides of the reflective element;

a second radiation unit, disposed on both sides of the reflective element;

a first impedance matching unit, disposed on the first surface corresponding to the first radiation unit;

a second impedance matching unit, disposed on the first surface corresponding to the second radiation unit;

a feed point, coupled between the first impedance matching unit and the second impedance matching unit;

a first conductive line, coupled to the feed point; and a second conductive line, coupled to the reflective element.

2. The antenna structure as claimed in claim 1, further comprising a first conductive element and a second conductive element, wherein the first conductive element is connected to the feed point and the first impedance matching unit, and the second conductive element is connected to the feed point and the second impedance matching unit.

3. The antenna structure as claimed in claim 2, wherein the first conductive element and the second conductive element are aligned on a straight line.

4. The antenna structure as claimed in claim 2, wherein the first impedance matching unit is a sleeve-shaped structure.

5. The antenna structure as claimed in claim 4, wherein the first impedance matching unit comprises a first portion and a second portion, the first portion is corresponding to the first radiation unit, the second portion is connected to the first conductive element, the width of the first conductive element is thinner than the width of the second portion, the radiation pattern of the antenna structure is modified by changing the length of the first conductive element and the second portion, and the impedance matching of the antenna structure is modified by changing the width of the first conductive element and the second portion.

6. The antenna structure as claimed in claim 5, wherein the second impedance matching unit comprises a third portion and a fourth portion, the third portion is corresponding to the second radiation unit, the fourth portion is connected to the second conductive element, the width of the second conductive element is thinner than the width of the fourth portion, the radiation pattern of the antenna structure is modified by changing the length of the second conductive element and the fourth portion, the impedance matching of the antenna structure is modified by changing the width of the second conductive element and the fourth portion, a total length of the first conductive element, the second conductive element, the second portion and the fourth portion is 0.8λ~1λ, and λ is a wave length of the wireless signal.

7. The antenna structure as claimed in claim 2, wherein the second impedance matching unit is a sleeve-shaped structure.

8. The antenna structure as claimed in claim 7, wherein the second impedance matching unit comprises a third portion and a fourth portion, the third portion is corresponding to the second radiation unit, the fourth portion is connected to the second conductive element, the width of the second conductive element is thinner than the width of the fourth portion, the radiation pattern of the antenna structure is modified by changing the length of the second conductive element and the fourth portion, and the impedance matching of the antenna structure is modified by changing the width of the second conductive element and the fourth portion.

9. The antenna structure as claimed in claim 2, further comprising a third conductive element, a third radiation unit and a third impedance matching unit, wherein the third conductive element is connected to the first impedance matching unit, the third impedance matching unit is connected to the third conductive element, and the third radiation unit is disposed on two sides of the reflective element corresponding to the third impedance matching unit.

10. The antenna structure as claimed in claim 9, wherein the third conductive element and the first conductive element are aligned on a straight line.

11. An electronic device, comprises:

a housing; and the antenna structure as claimed in claim 1, disposed in the housing.

12. The electronic device as claimed in claim 11, wherein the antenna structure further comprises a first conductive element and a second conductive element, the first conductive element is connected to the feed point and the first impedance matching unit, and the second conductive element is connected to the feed point and the second impedance matching unit.

13. The electronic device as claimed in claim 12, wherein the first conductive element and the second conductive element are aligned on a straight line.

14. The electronic device as claimed in claim 12, wherein the first impedance matching unit is a sleeve-shaped structure.

15. The electronic device as claimed in claim 14, wherein the first impedance matching unit comprises a first portion and a second portion, the first portion is corresponding to the first radiation unit, the second portion is connected to the first conductive element, the width of the first conductive element is thinner than the width of the second portion, the radiation pattern of the antenna structure is modified by changing the length of the first conductive element and the second portion, and the impedance matching of the antenna structure is modified by changing the width of the first conductive element and the second portion.

16. The electronic device as claimed in claim 15, wherein the second impedance matching unit comprises a third portion and a fourth portion, the third portion is corresponding to the second radiation unit, the fourth portion is connected to the second conductive element, the width of the second conductive element is thinner than the width of the fourth portion, the radiation pattern of the antenna structure is modified by changing the length of the second conductive element and the fourth portion, the impedance matching of the antenna structure is modified by changing the width of the second conductive element and the fourth portion, a total length of the first conductive element, the second conductive element, the second portion and the fourth portion is $0.8\lambda \sim 1\lambda$, and $\lambda$ is a wave length of the wireless signal.

17. The electronic device as claimed in claim 12, wherein the second impedance matching unit is a sleeve-shaped structure.

18. The electronic device as claimed in claim 17, wherein the second impedance matching unit comprises a third portion and a fourth portion, the third portion is corresponding to the second radiation unit, the fourth portion is connected to the second conductive element, the width of the second conductive element is thinner than the width of the fourth portion, the radiation pattern of the antenna structure is modified by changing the length of the second conductive element and the fourth portion, and the impedance matching of the antenna structure is modified by changing the width of the second conductive element and the fourth portion.

19. The electronic device as claimed in claim 12, wherein the antenna structure further comprises a third conductive element, a third radiation unit and a third impedance matching unit, the third conductive element is connected to the first impedance matching unit, the third impedance matching unit is connected to the third conductive element, and the third radiation unit is disposed on two sides of the reflective element corresponding to the third impedance matching unit.

20. The electronic device as claimed in claim 19, wherein the third conductive element and the first conductive element are aligned on a straight line.

* * * * *